US010135139B2

(12) United States Patent
Contreras et al.

(10) Patent No.: US 10,135,139 B2
(45) Date of Patent: Nov. 20, 2018

(54) MULTIBAND ANTENNA SYSTEM

(71) Applicant: MOTOROLA SOLUTIONS, INC, Schaumburg, IL (US)

(72) Inventors: Nereydo T Contreras, Fort Lauderdale, FL (US); Giorgi G. Bit-Babik, Plantation, FL (US); Antonio Faraone, Fort Lauderdale, FL (US); William R. Williams, Coral Springs, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 797 days.

(21) Appl. No.: 14/328,257

(22) Filed: Jul. 10, 2014

(65) Prior Publication Data

US 2016/0013553 A1 Jan. 14, 2016

(51) Int. Cl.

| | |
|---|---|
| ***H01Q 5/50*** | (2015.01) |
| ***H01Q 1/24*** | (2006.01) |
| ***H01Q 1/36*** | (2006.01) |
| ***H01Q 1/08*** | (2006.01) |
| ***H01Q 21/30*** | (2006.01) |
| *H01Q 5/335* | (2015.01) |

(52) U.S. Cl.
CPC ..... *H01Q 5/50* (2015.01); *H01Q 1/085* (2013.01); *H01Q 1/242* (2013.01); *H01Q 1/244* (2013.01); *H01Q 1/362* (2013.01); *H01Q 21/30* (2013.01); *H01Q 5/335* (2015.01)

(58) Field of Classification Search
CPC ..... H01Q 5/50; H01Q 1/085
USPC ..... 343/702
See application file for complete search history.

(56) References Cited

U.S. PATENT DOCUMENTS

| | | | | |
|---|---|---|---|---|
| 4,772,895 A * | 9/1988 | Garay | H01Q 1/362 343/752 |
| 7,502,638 B2 * | 3/2009 | Shimizu | H01Q 1/242 343/750 |
| 8,466,844 B2 | 6/2013 | Ying | |
| 2005/0057404 A1 * | 3/2005 | Demicco | H01Q 1/088 343/702 |

(Continued)

FOREIGN PATENT DOCUMENTS

| | | |
|---|---|---|
| WO | 2001003236 A1 | 1/2001 |
| WO | 2012146964 A1 | 11/2012 |
| WO | 20140008508 A1 | 1/2014 |

OTHER PUBLICATIONS

Corresponding International Application No. PCT/US2015/037059—International Search Report with Written Opinion, dated Aug. 14, 2015—12 pp.

(Continued)

*Primary Examiner* — Dameon E Levi
*Assistant Examiner* — Walter Davis
(74) *Attorney, Agent, or Firm* — Barbara R. Doutre

(57) ABSTRACT

An antenna enables compact and robust multiband operation of portable radios. According to some embodiments, the antenna includes: a first rolled conductive strip having a first section with overlap between successive turns of the first conductive strip and a second section with no overlap between successive turns of the first conductive strip, the first section having an insulating layer between the overlapping successive turns of the first conductive strip; a second rolled conductive strip; and a flexible sheet to which both the first conductive strip and the second conductive strip are bonded.

22 Claims, 7 Drawing Sheets

(56) References Cited

U.S. PATENT DOCUMENTS

| | | | | |
|---|---|---|---|---|
| 2008/0055172 | A1 | 3/2008 | Chen | |
| 2009/0295672 | A1* | 12/2009 | Grossman | H01Q 1/362 343/866 |
| 2013/0307735 | A1* | 11/2013 | Contreras | H01Q 1/242 343/702 |

OTHER PUBLICATIONS

Contreras et al—U.S. Appl. No. 14/068,156, filed Oct. 31, 2013; Assignee—Motorola Solutions, Inc.—As filed.

* cited by examiner

BACK VIEW

SIDE VIEW

FRONT VIEW

MULTIBAND ANTENNA SYSTEM

FIELD OF THE DISCLOSURE

The present disclosure relates generally to antennas, and more particularly to antennas providing multiband frequency operation for portable radio communication devices.

BACKGROUND OF THE INVENTION

As wireless communication devices evolve toward smaller sizes the desire to incorporate additional features into such devices continues to increase. Communication devices such as portable two-way radios that operate over different frequency bands are considered desirable, particularly in the public-safety arena. Such devices are commonly used by police departments, fire departments, emergency medical responders, and the military, to name a few, and such organizations often own systems operating in different frequency bands. Thus the need for reliable inter-agency communications in emergency situations drives the need for wireless communication devices that enable reliable interoperability across systems. The use of separate antennas to cover different frequency bands is often not a practical option in view of the portability and size limitations of such devices, as well as the mentioned interoperability requirement.

One particularly useful combination of bands desirable to achieve in a portable two-way radio antenna comprises a very high frequency (VHF) band, an ultra-high frequency (UHF) band and a 7/800 MHz frequency band. Other bands could also be desirable, for instance a global positioning system (GPS) band or a long-term evolution (LTE) public-safety band. Furthermore, due to the need of emergency personnel to carry a portable two-way radio during an entire work shift and to operate effectively in dangerous environments, problems with antenna stiffness, durability and overall size also must be considered when developing a new radio design.

It is especially challenging to combine the above referenced bandwidths into a single antenna structure. To be an effective radiator, antennas (also called radiating elements) normally have electrical lengths equal to, or some multiple of, a quarter of the transmitted or received signal wavelength $\lambda$. A good compromise between length and radiating performance for many portable radios is $\lambda/4$. Thus, a VHF radiating element designed according to this criterion has a relatively long physical length of about 50 cm at the center of the VHF band, while a UHF radiating element of $\lambda/4$ is about 18 cm, and a 7/800 MHz radiating element electrical length of $\lambda/4$ is about 9 cm. Creating a single length antenna that works efficiently at these disparate frequencies, while also minimizing the overall length and maximizing its flexibility, is difficult.

Accordingly, it is desirable to provide a multi-band antenna system while retaining a relatively small form factor.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
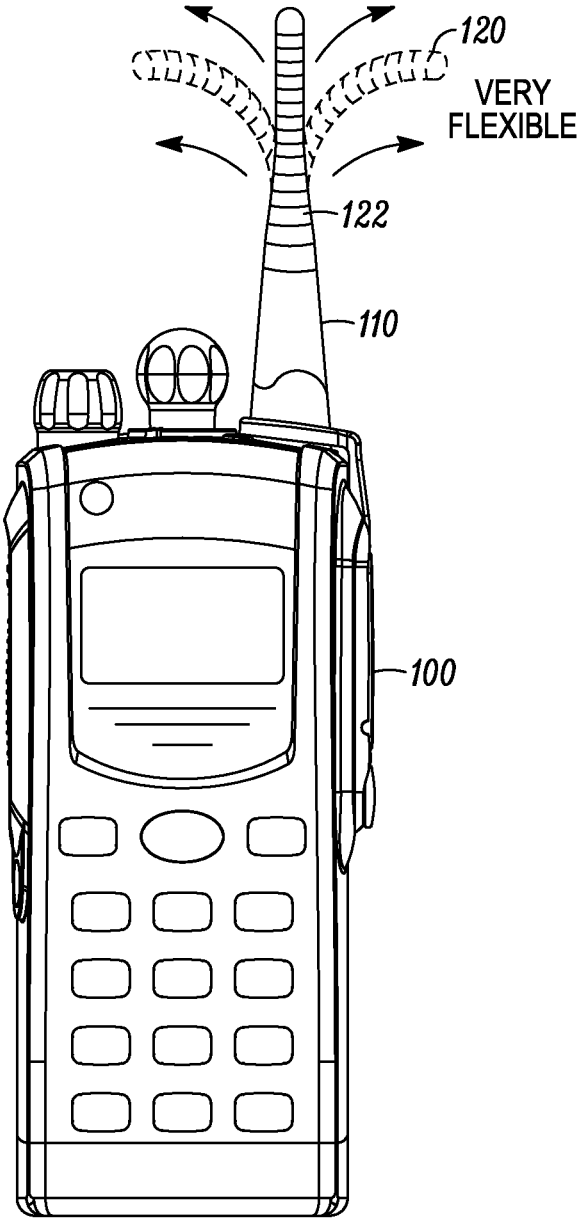
FIG. 1 illustrates a front view of a portable radio including a multiband antenna system, according to some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

According to some embodiments of the present disclosure, a multiband antenna system includes a printed circuit board (PCB); a low frequency (LF) matching circuit operatively connected to the PCB, the LF matching circuit having a radio port and a distal port; a high frequency (HF) matching circuit operatively connected to the PCB, the HF matching circuit having a radio port and a distal port; a stripline operatively connected to the PCB, the stripline providing a common ground for the HF and LF matching circuits; a first radiator element operatively connected to the distal port of the LF matching circuit and to the distal port of the HF matching circuit; a second radiator element operatively connected to the radio port of the LF matching circuit or to the radio port of the HF matching circuitry; and an antenna rod, wherein both the first radiator element and the second radiator element are coiled around the antenna rod.

Advantages of the present disclosure include enabling effective, compact and robust multiband antenna systems. For example, very high frequency (VHF), ultra-high frequency (UHF), 7-800 MHz, and Global Navigation Satellite System (GNSS) capabilities can be all combined into a single antenna system, providing significant versatility to portable modern radio communications equipment. By combining two radiator elements on a single flexible sheet, manufacturing costs can be reduced while the reliability and robustness of the antenna system is increased. Also, according to some embodiments, alignment features incorporated into a PCB assist in ensuring accurate and permanent positioning of the flexible sheet during assembly and use, while the soldering joints between the radiator elements and the PCB further contribute to the durability of the mechanical assembly.

FIG. 1 illustrates a front view of a portable radio 100 including a multiband antenna system 110, according to some embodiments. For example, the radio 100 can be a land mobile radio (LMR) designed to operate over multiple frequency bands, including a VHF band (about 136-174 MHz), a UHF band (about 380-520 MHz), a 7/800 MHz frequency band (about 764-869 MHz), and GNSS bands such as Global Positioning System (GPS) bands (centered for example at 1575.2 MHz), and the GLONASS band (about 1592-1610 MHz). The radio 100 and the multiband antenna system 110 is thus particularly advantageous for public-safety providers (e.g., police, fire department, emergency medical responders, and the military) by providing increased communication options.

As shown, an upper portion 120 of the antenna system 110 is very flexible. The entire length of the antenna system 110 is covered by a protective overmold 122. For example, the overmold 122 can be made of flexible rubber, silicone, or another suitable material. Alternatively, the entire length of the antenna system 110 can be enclosed in a protective sleeve made out of similar materials.

In accordance with the embodiments, antenna system 110 comprises first and second radiator elements and electronic circuitry formed and operating for multiband operation as described in conjunction with the remaining figures.

Figure 2:
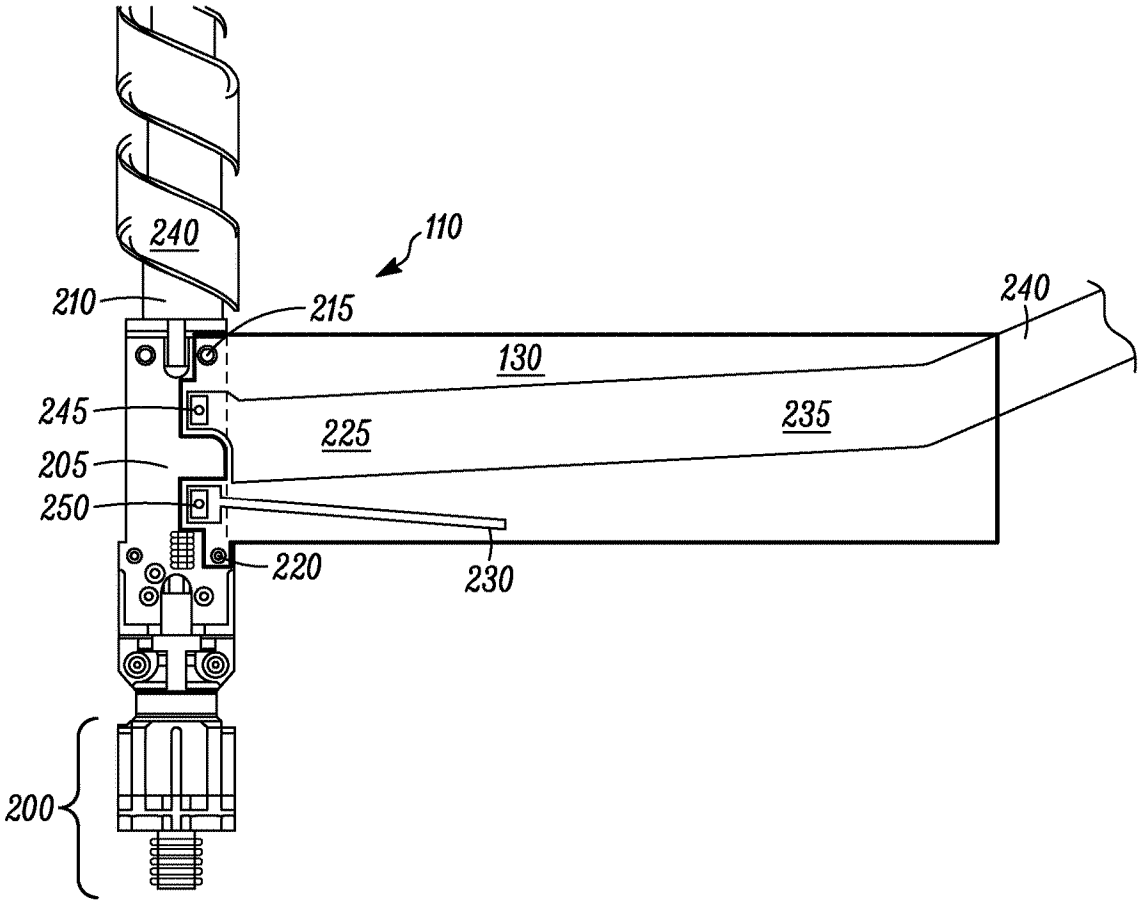
FIG. 2 illustrates a back view of a lower portion of the antenna system shown in FIG. 1, with a portion of the casing removed, according to some embodiments.

FIG. 2 illustrates a back view of a lower portion of the antenna system 110 with a portion of the casing removed, according to some embodiments. A base 200 of the antenna system 110 includes an RF (radio frequency) co-axial connector that is threaded into an RF port of the radio 100. A printed circuit board (PCB) 205 is positioned adjacent to the base 200 and is attached to a flexible, core, non-conductive rod 210 that extends to a distal end of the antenna system 110.

The rolled flexible sheet 130 is attached to the PCB 205 by two alignment pins 215, 220, which assist in ensuring consistent and repeatable positioning of the flexible sheet 130 during assembly of the antenna system 110.

In accordance with the various embodiments, the rolled flexible sheet 130 includes a first rolled conductive strip defining a first radiator element 225 and a second rolled conductive strip defining a second radiator element 230 of the antenna system 110. The flexible sheet 130 may be formed of a single-sided flex circuit board having a conductive side, such as copper or other suitable conductor, and a non-conductive side, such as a polyimide film. Polyimide films, for example Kapton®, provide high performance, reliability and durability under various environmental conditions. The shape of the flattened (i.e., unrolled) flexible sheet 130 shows a first section 235 being formed of a width suitable for wrapping around the PCB 205 with overlapping successive turns. A second section 240 of the first radiator element 225 is formed at a greater angle from the perpendicular to the axis of the rod 210 than the first section 235 to enable wrapping about the rod 210 with non-overlapping successive turns. The second section 240 is shown in FIG. 2 in both the flattened position, extended away from the PCB 205 as used during initial assembly, and in the wrapped position achieved after assembly is completed.

The flexible sheet 130 also includes solder points or contacts 245, 250 for mounting to corresponding pads on the PCB 205.

According to an embodiment, the first radiator element 225 defines a UHF/VHF/7-800 MHz band antenna and the second radiator element 230 defines a GNSS antenna. Due to the much higher frequencies of GNSS bands (such as 1575.2 MHz) the $\lambda/4$ design parameters enable the second radiator element 230 to be much shorter than the first radiator element 225. For example, the first radiator element 225 (the distal end of which is shown truncated in FIG. 2) can be about 16 cm to 24 cm long, and the second radiator element 230 can be about 3 cm long.

As shown in FIG. 2, the first radiator element 225 is angled upward from left to right across the flattened flexible sheet 130, and the second radiator element 230 is angled, preferably downward in order to limit coupling with the first antenna 225, from left to right across the sheet 130. This ensures a controlled spacing between the first radiator element 225 and the second radiator element 230 during assembly and use of the antenna system 110.

As will be understood by those having ordinary skill in the art, and depending on the size of the protective overmold 122 and the length of the rod 210, adjustments can be made to the shape and relative positioning of the first radiator element 225 and the second radiator element 230. For instance, neither the first section 235 nor the second section 240 of the first radiator element 225 necessarily needs to be straight or have constant width along their respective elongated path.

In accordance with various embodiments, the PCB 205 can comprise multiple dielectric layers. Conductive circuit patterns can be interposed between adjacent dielectric layers. Conductive circuit patterns also can be realized on the outside surfaces of the outermost dielectric layers. Further, conductive circuit patterns can be electrically interconnected through conductive vias crossing one or more dielectric layers, or other suitable means. For instance, the PCB 205 may be realized using two layers of glass-reinforced epoxy laminate sheet, such as FR4, with a copper circuit pattern interposed between them and copper circuit patterns realized on the outer surfaces of each dielectric layer. Alternatively, the PCB 205 can be realized using a single-sided flex circuit board having a conductive side, such as copper or other suitable conductor, and a non-conductive side, such as a polyimide film, for example Kapton®.

When the flexible sheet 130 is realized using a single-sided flex circuit board, it is possible to extend the same flex circuit board to realize the PCB 205. In such an embodiment, there is no need to realize solder points or contacts 245, 250; rather, the electrical interface (or interfaces) between the PCB 205 and flexible sheet 130 occurs (or occur) anywhere within the PCB 205 portion of the flex circuit board. An advantage to using such an approach is that the PCB 205 and the flexible sheet 130 are realized as a single part with no need for assembly. However, the more general approach of including the PCB 205 and the flexible sheet 130 as separate parts is described below.

Figure 3:
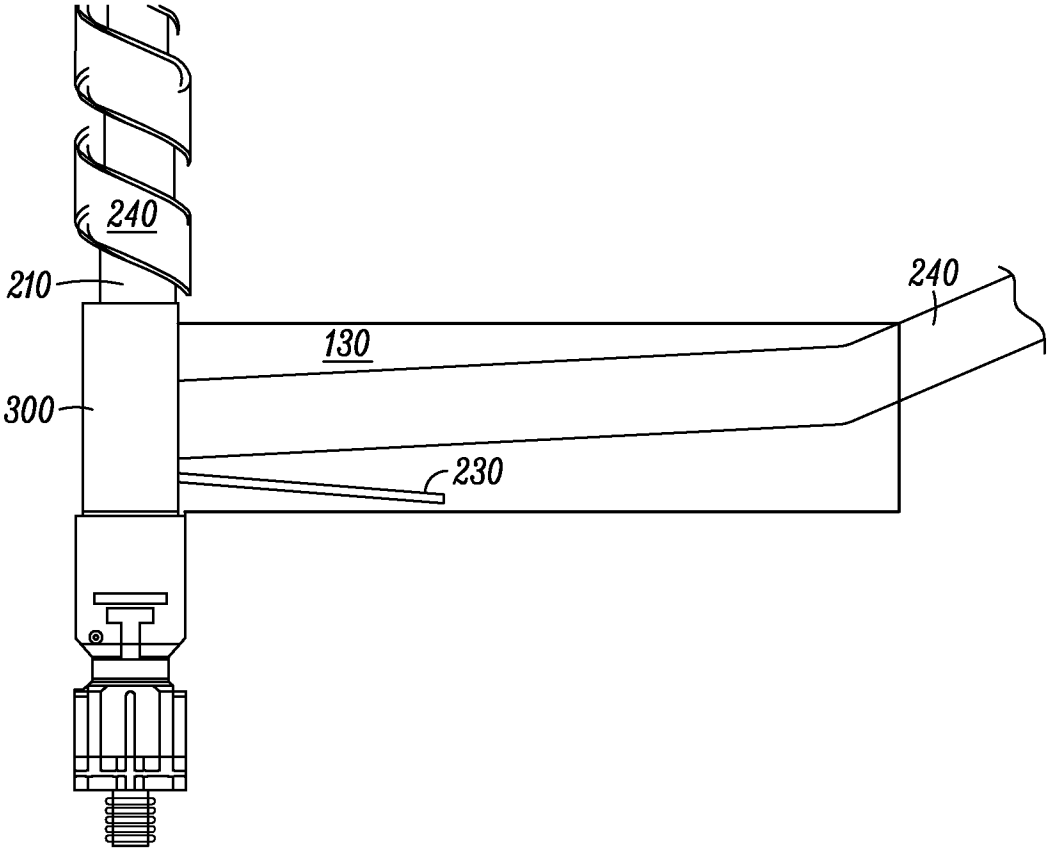
FIG. 3 illustrates a back view of the lower portion of the antenna system of FIG. 2, with the full casing in place, according to some embodiments.

FIG. 3 illustrates a back view of the lower portion of the antenna system 110, according to some embodiments. One half of a "clamshell" casing 300 is shown covering a back of the PCB 205. A second half (not shown) of the casing 300 is used to cover the front of the PCB 205.

Figure 4:
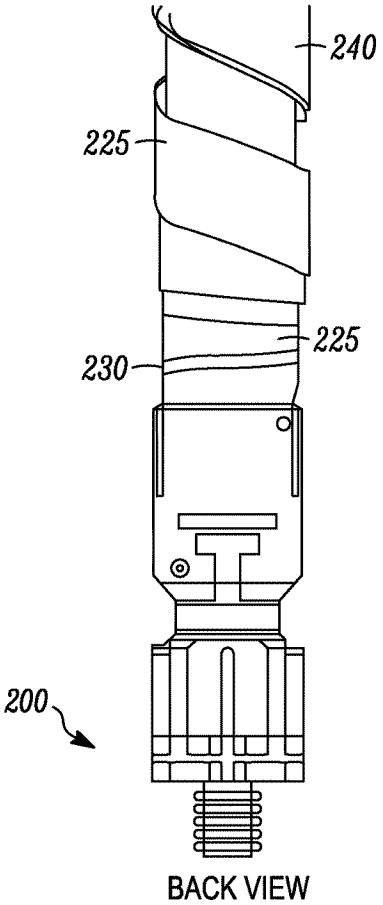
FIG. 4 illustrates a further back view of the lower portion of the antenna system of FIG. 3, showing a first radiator element and a second radiator element helically wrapped around the casing, according to some embodiments.

FIG. 4 illustrates a further back view of the lower portion of the antenna system 110, showing the first radiator element 225 and the second radiator element 230 helically wrapped around the casing 300. As shown, the first radiator element 225 winds helically upward toward the distal end of the antenna system 210, and the second radiator element 230 winds helically downward toward the base 200. For purposes of clear illustration the non-conductive portions of the flexible sheet 130 are not shown.

Figure 5:
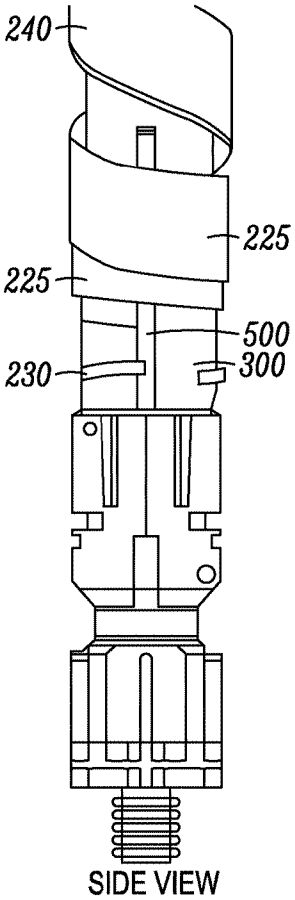
FIG. 5 illustrates a side view of the embodiment shown in FIG. 4.

FIG. 5 illustrates a side view of the embodiment shown in FIG. 4. As shown, the second radiator element 230 wraps approximately 300 degrees (although it may wrap in excess of a whole turn, if so desired) around the casing 300; however the helical winding of the second radiator element 230 does not overlap with itself. A slot 500 is defined by two halves of the "clamshell" casing 300 and enables the radiator elements 225, 230 to extend out of the casing 300.

Figure 6:
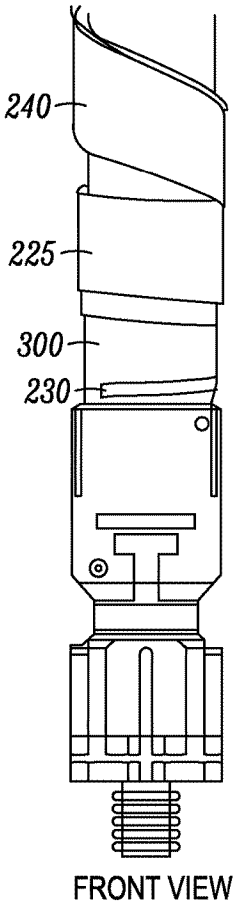
FIG. 6 illustrates a front view of the embodiment shown in FIG. 4.

FIG. 6 illustrates a front view of the embodiment shown in FIG. 4.

Only the first section 235 of the flexible sheet 130 that has overlapping successive turns will generally require an insulating layer, to avoid electrical shorts between successive turns. However, also having an insulating layer extending to the distal end of the flexible sheet 130 may facilitate the manufacturing of the flexible sheet 130. Additionally, the use of a polyimide film as the insulating layer provides some capacitance and inductance characteristics that can improve performance of the antenna system 110 at UHF and higher frequencies. Thus, the use of the insulating layer may not only eliminate shorts but also may enhance performance. For instance, in some embodiments, controlling the capacitance between successive overlapping turns and the overall inductance of the flexible sheet 130 allows readily tuning the frequency resonance of the antenna system 110 within the UHF band, with minimal effect on the VHF and 7/800 MHz resonances. Also, from a manufacturing standpoint forming the flexible sheet 130 as a single-sided flex circuit board with the insulation along the entire sheet or predetermined portions of the sheet provides a low cost component which is more easily manufactured and assembled.

The rod 210 may be made of silicone, or other suitably flexible elastomeric material with good RF properties, such as low RF losses. In some embodiments the rod 210 decreases in diameter along a vertical axis. This feature can be advantageous in achieving flexibility in the distal end while enabling enough volume in the radio end to host the PCB 205 and associated electronics.

Figure 7:
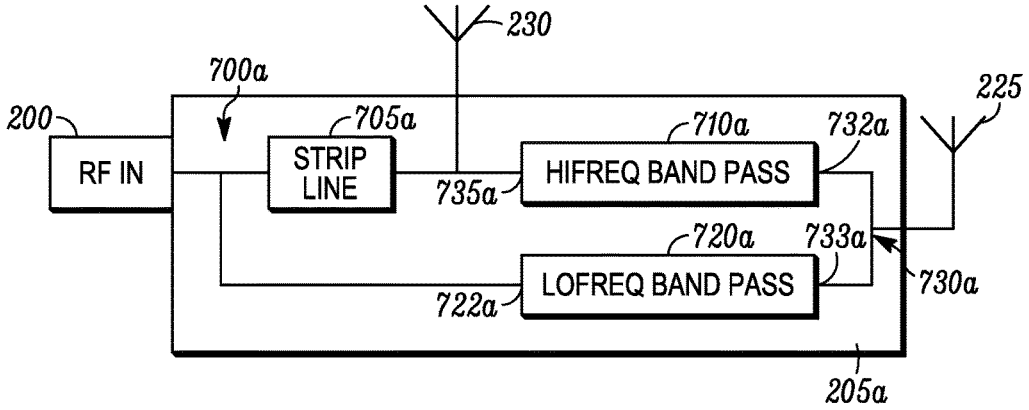
FIGS. 7, 8 and 9 illustrate three alternative embodiments of elements of a printed circuit board (PCB) of the antenna system of FIG. 1, including different configurations of impedance matching circuitry and relative electrical connections to the second radiator element.
Figure 8:
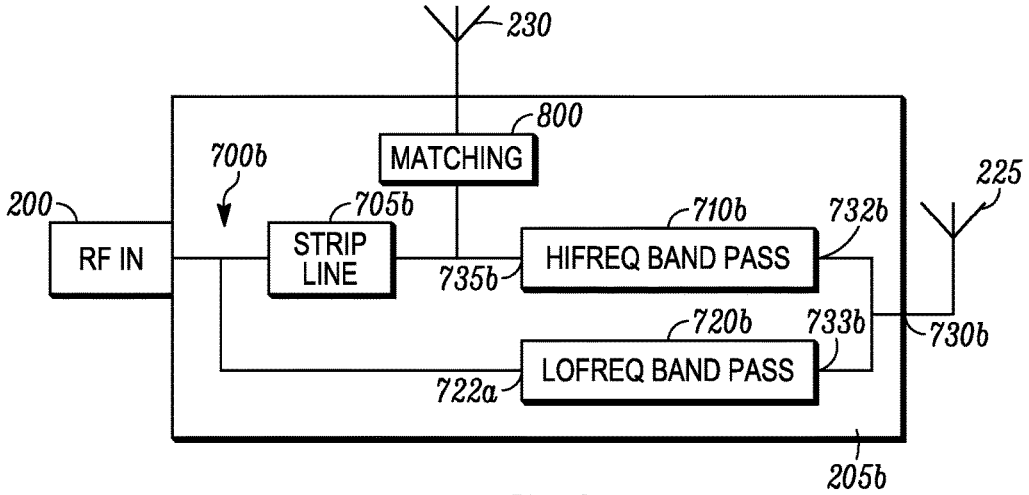
Figure 9:
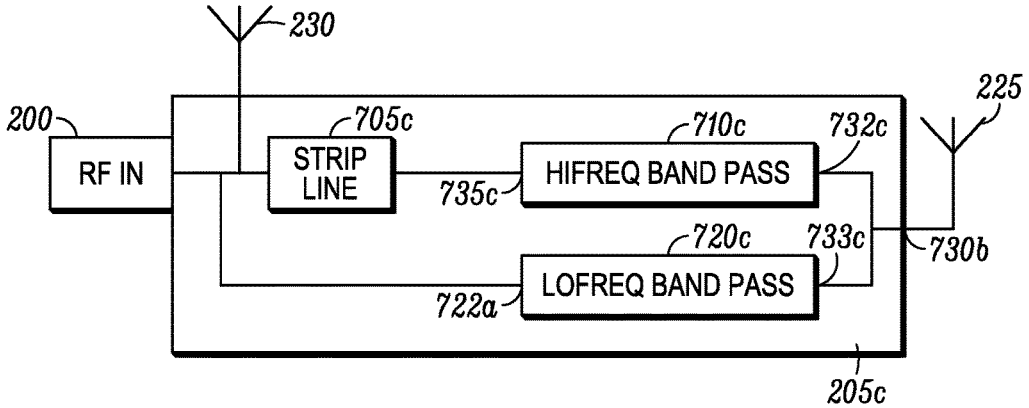

FIGS. 7, 8 and 9 illustrate three alternative embodiments of the PCB 205, including different configurations of impedance matching circuitry and relative electrical connections to the second radiator element 230. FIG. 7 illustrates a PCB 205*a* including a diplexed matching circuit in which current is fed through the RF connector in the base 200 and then splits at a point 700*a* into two paths. A first path leads through a strip line 705*a* to a high frequency matching circuit in the form of a high frequency band pass matching and broadbanding circuit 710*a*. A second path leads to a low frequency matching circuit in the form of a low frequency band pass matching and broadbanding circuit 720*a* having an input or radio port 722*a*. The low frequency band pass matching and broadbanding circuit 720*a* can be a low-pass circuit. Both paths then converge at an antenna feed point 730*a* corresponding to distal ports 732*a*, 733*a* of both matching and broadbanding circuits 710*a*, 720*a*, respectively, and are electrically connected to the first radiator element 225. The second radiator element 230 is electrically connected to the PCB 205*a* between the stripline 705*a* and a radio port 735*a* of the high frequency band pass matching and broadbanding circuit 710*a*.

As understood by those having ordinary skill in the art, the stripline 705*a* features two stripline ground layers which preferably are stitched together through metal vias along the edges so as to shield the signal line from external electromagnetic fields and provide a controlled impedance path for signals, which preferably provides a common ground for both the high frequency band pass matching and broadbanding circuit 710*a* and for the low frequency band pass matching and broadbanding circuit 720*a*. The stripline 705*a* thus operates as a matching element and ground that provides a return current path for both high and low frequency signals. Alternatively, although not preferably, the stripline function can be effected by a microstrip, which would only feature one ground layer available to return currents for the low and high pass circuits. The microstrip, being an open transmission line, is not desirable since the signal conductor is not shielded from external fields. The stripline 705*a* is formed of a predetermined length and width which together with the matching and broadbanding circuits 710*a*, 720*a* controls the broadband frequency response of the antenna system 110. The use of the stripline 705*a* beneficially negates the need for a dedicated RF ground layer that would introduce undesirable parasitic capacitances formed with the circuit component pads and interconnecting lines, which would hamper the ability of the matching circuits 710*a*, 720*a* to provide an effective broadbanding and matching function.

FIG. 8 illustrates alternative circuitry of a PCB 205*b*. Such circuitry is similar to the circuitry of the PCB 205*a* and PCB 205*b*, and includes a stripline 705*b*, a high frequency band pass matching and broadbanding circuit 710*b* and a low frequency band pass matching and broadbanding circuit 720*b*. However, in the PCB 205*b* a separate matching circuit 800 is added at the base of the second radiator element 230. According to some embodiments, advantages of the matching circuit 800 can include the ability to decouple the radiator element 230 from the rest of the circuitry, for instance through the introduction of resonant circuit configurations that enable coupling of the radiator element 230 to said circuitry, and ultimately to the RF transmitter and receiver inside the case of the portable radio 100. Such coupling preferably occurs only in the frequency range where the radiator 230 is designed to be operational, but not in the frequency range where the radiator element 225 is designed to be operational.

FIG. 9 illustrates alternative circuitry of a PCB 205*c*. Such circuitry is similar to the circuitry of the PCB 205*a*, and includes a stripline 705*c*, a high frequency band pass matching and broadbanding circuit 710*c* and a low frequency band pass matching and broadbanding circuit 720*c*. However, in the PCB 205*c* the second radiator element 230 is electrically connected to the PCB 205*c* between the co-axial connector at the base 200 and the strip line 705*c*. According to some embodiments, advantages of this positioning of the second radiator element 230 can include the ability to take advantage of the parallel impedance provided by the stripline 705*c* in order to achieve a desired impedance behavior in the frequency range where the radiator element 230 is designed to be operational. Clearly, although it is not shown, the matching circuit 800 could also be added in the aforementioned manner to the configuration shown in FIG. 9 to provide the described advantages.

Figure 10:
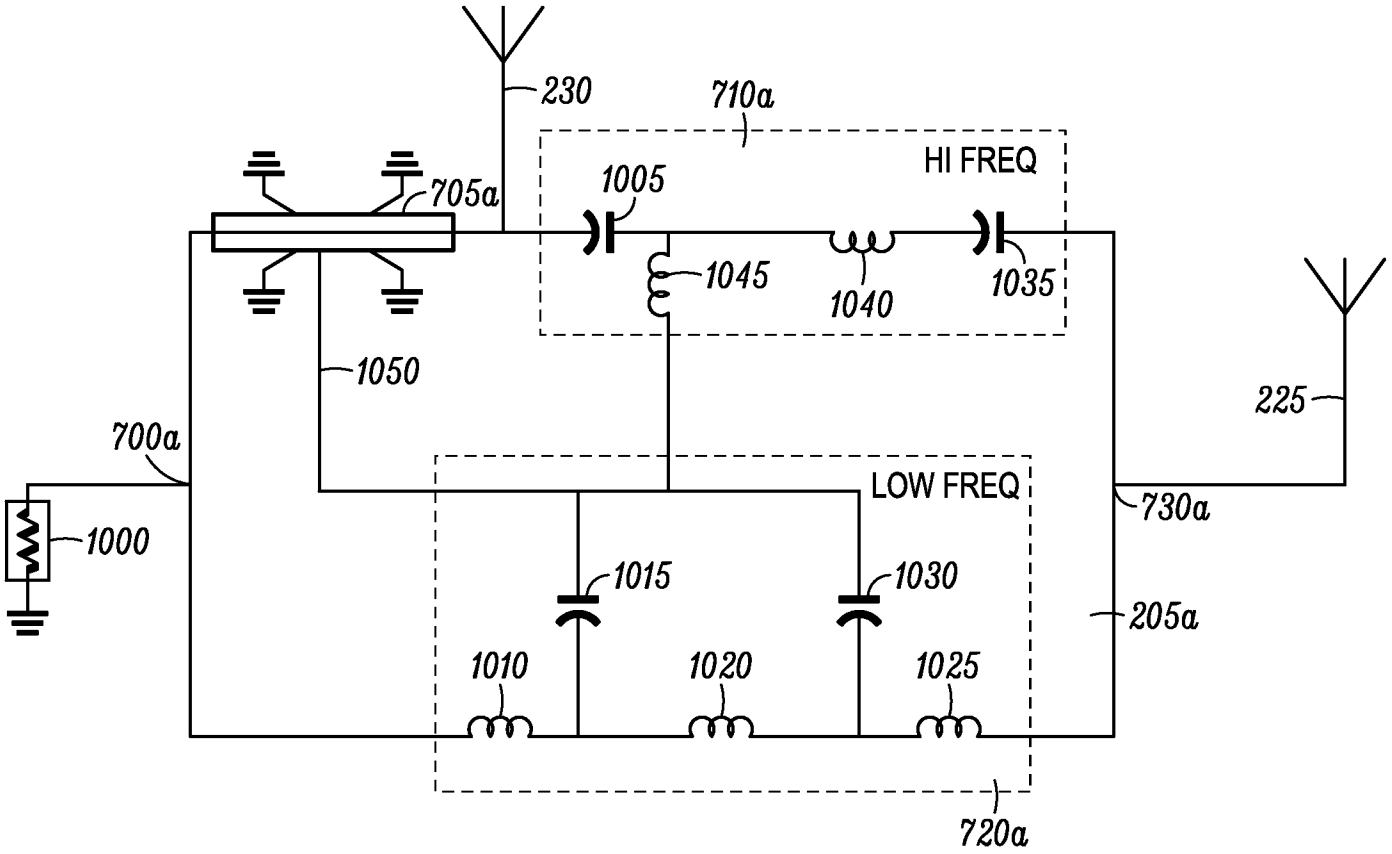
FIG. 10 illustrates a detailed view of the circuitry of the PCB shown in FIG. 7.

FIG. 10 illustrates a detailed view of the circuitry of the PCB 205*a* shown in FIG. 7. An RF input 1000 forms part of the base 200 of the antenna system 110. During signal reception in the GNSS band, positioning of the second radiator element 230 just after the strip line 705*a* enables signals received through the second radiator element 230 to be unaffected by the high frequency band pass matching and broadbanding circuit 710*a* and the low frequency band pass matching and broadbanding circuit 720*a*.

During operation in the VHF band, a VHF signal is received at the RF input 1000 and is blocked by capacitor 1005 in the high frequency bandpass matching and broadbanding circuit 710*a*. The signal is filtered through a low pass matching and broadbanding circuit formed by inductor 1010, capacitor 1015, inductor 1020, inductor 1025 and capacitor 1030. Capacitor 1035 provides a blocking capacitor to prevent low frequency feedback into the high frequency bandpass matching and broadbanding circuit 710*a*. As mentioned earlier, the low frequency band pass matching and broadbanding circuit 720*a* can also be designed to effect a band pass function, for instance by placing an inductor (not shown) in parallel with either one of capacitor 1015 or capacitor 1030, to improve isolation of the radio receiver from potential disturbances induced by RF sources operating at frequencies below VHF, for instance in the FM radio band up to about 108 MHz.

The high frequency bandpass matching and broadbanding circuit 710*a* is formed of a plurality of lumped element impedance matching components comprising the capacitor 1005, providing a block for the VHF signals that are injected from the stripline 705*a*, connected with inductor 1040 having inductor 1045 coupled in between to a common stripline ground 1050. The effectiveness of the matching function at UHF and 7/800 MHz can be significantly improved by allowing components to be placed very close to each other and to the antenna feed point 730*a*, thereby reducing the parasitic inductances and capacitances that would be produced by longer interconnections.

During operation in the UHF band or 7/800 MHz band, the high frequency signal is received at RF input 1000 and coupled through the stripline 705*a* for filtering through the high frequency bandpass matching and broadbanding circuit 710*a*. The inductor 1025 functions as a high frequency choke and prevents high frequency feedback into the low frequency bandpass matching and broadbanding circuit 720*a*.

Figure 11:
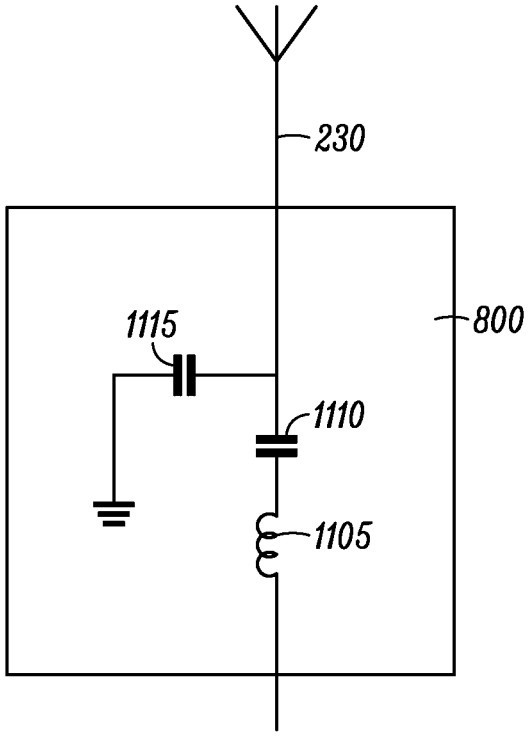
FIG. 11 illustrates elements of a matching circuit disposed on a PCB, according to some embodiments.

FIG. 11 illustrates elements of the matching circuit 800 of FIG. 8 disposed on the PCB 205*b*, according to some embodiments. As understood by those having ordinary skill in the art, an inductor 1105 and capacitors 1110 and 1115 are tunable as an LC circuit to provide effective impedance matching between the strip line 705*b* and the second radiator element 230. The series connection between the inductor 1105 and capacitor 1110 serves as a resonant bandpass filter that allows the radiator element 230 to couple with the rest of the circuitry in a frequency range about the resonance frequency where the radiator element 230 is designed to be operational. The stripline ground 705*b* can provide the ground connection shown for the capacitor 1115.

In summary, advantages of the present disclosure include enabling effective, compact and robust multiband antenna systems. For example, VHF, UHF and GNSS capabilities can be all combined into a single antenna system, providing significant versatility to portable modern radio communications equipment. By combining two radiator elements on a single flexible sheet, manufacturing costs can be reduced while the reliability and robustness of the antenna system is increased. Also, according to some embodiments, alignment features incorporated into a PCB assist in ensuring accurate and permanent positioning of the flexible sheet during assembly and use. The compact structure is highly advantageous to handheld portable battery operated radios having limited space.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a . . . ", "has a . . . ", "includes a . . . ", "contains a . . . " does not, without more constraints, preclude the existence of additional identical elements in the process, method, article, or apparatus that comprises, has, includes, contains the element. The terms "a" and "an" are defined as one or more unless explicitly stated otherwise herein. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A multiband antenna system, comprising: a printed circuit board (PCB); a casing enclosing the PCB;

a low frequency (LF) matching circuit operatively connected to the PCB, the LF matching circuit having a radio port and a distal port;

a high frequency (HF) matching circuit operatively connected to the PCB, the HF matching circuit having a radio port and a distal port;

a strip line operatively connected to the PCB, the strip line providing a common ground for the HF and LF matching circuits;

a flexible, core, non-conductive rod coupled to the PCB that extends to a distal end of the antenna system: a first radiator element operatively connected to the distal port of the LF matching circuit and to the distal port of the HF matching circuit, wherein the first radiator element winds helically upward angled from left to right toward the distal end of the antenna system, the first radiator element comprising a first section formed of width suitable for wrapping around the casing of the PCB with overlapping successive turns, and the first radiator element comprising a second section formed at an angle that enables wrapping the flexible rod in non-overlapping successive turns: a second radiator element operatively connected the radio port of the LF matching circuit or to the radio port of the HF matching circuit, wherein the second radiator element winds helically downward angled from right to left toward a base of the antenna system, thereby limiting coupling between the first and second radiator elements, and the first radiator element and the second radiator element being printed on a single flexible sheet.

2. The multiband antenna system of claim 1, wherein the single flexible sheet is attached to the PCB using at least two alignment pins.

3. The multiband antenna system of claim 1, wherein the LF matching circuit operates over a VHF band, the HF matching circuit operates over both a UHF band and a 700-800 MHz band.

4. The multiband antenna system of claim 1, wherein the second radiator element operates at frequencies above 1200 MHz.

5. The multiband antenna system of claim 1, wherein the second radiator element is connected to the PCB between the strip line and the radio port of the HF matching circuit.

6. The multiband antenna system of claim 1, further comprising a third matching circuit operatively connected to the second radiator element.

7. The multiband antenna system of claim 6, wherein the third matching circuit is disposed on the PCB.

8. The multiband antenna system of claim 1, wherein the multiband antenna system is coupled to a handheld radio.

9. An antenna, comprising:

a first rolled conductive strip having a first section with overlap between successive turns of the first conductive strip and a second section with no overlap between successive turns of the first conductive strip, the first section having an insulating layer between the overlapping successive turns of the first rolled conductive strip;

a second rolled conductive strip; and a single flexible sheet upon which both the first rolled conductive strip and the second rolled conductive strip are printed, wherein the first and second sections of the first rolled conductive strip winds helically upward angled from left to right toward a distal end of the antenna system, and the second rolled conductive strip winds helically downward angled from left to right toward a base of the antenna system, thereby limiting coupling between the first and second radiator elements.

10. The antenna of claim 9, further comprising an antenna rod and a casing, wherein the single flexible sheet is wrapped around the antenna rod and the casing.

11. The antenna of claim 9, further comprising:

impedance matching circuitry coupled to the first and second rolled conductive strips; and a casing for encasing the impedance matching circuitry.

12. The antenna of claim 9, wherein the first rolled conductive strip operates as a first radiator element in a VHF band, a UHF band, and a 700-800 MHz band, and wherein the second rolled conductive strip operates as a second radiator element at frequencies over 1200 MHz.

13. The antenna of claim 9, wherein the flexible sheet is attached to a PCB.

14. The antenna structure of claim 13, wherein the flexible sheet is attached to the PCB using at least two alignment pins.

15. The antenna of claim 9, wherein the antenna structure has a length shorter than or equal to 20 centimeters (cm).

16. The antenna of claim 9, wherein the antenna structure is coupled to a handheld radio to provide multiband operation.

17. The multiband antenna system of claim 1, wherein the second section of the first radiator element wrapped around the flexible rod forms a non-constant width extending to the distal end of the antenna system.

18. The antenna of claim 9, wherein the second section of the first radiator element wrapped around the flexible rod forms a non-constant width extending to the distal end of the antenna system.

19. The multiband antenna system of claim 1, wherein the first radiator element defines a UHF/VHF/7-800 MHz band antenna and the second radiator element 230 defines a GNSS antenna.

20. The antenna of claim 9, wherein the first rolled conductive strip defines a UHF/VHF/7-800 MHz band antenna and the second rolled conductive strip defines a GNSS antenna.

21. The multiband antenna system of claim 1, wherein the first radiator element has a length of 16 cm to 24 cm long, and the second radiator element has a length of 3 cm.

22. The antenna of claim 9, wherein the first rolled conductive strip has a length range of 16 cm to 24 cm long, and the first rolled conductive strip has a length of 3 cm.

* * * * *